United States Patent [19]

Jolly

[11] Patent Number: 4,723,777

[45] Date of Patent: Feb. 9, 1988

[54] BASKETBALL GOAL AND BACKBOARD UNIT

[75] Inventor: James D. Jolly, Glen Dean, Ky.

[73] Assignee: Gared Company, St. Louis, Mo.

[21] Appl. No.: 865,928

[22] Filed: May 14, 1986

Related U.S. Application Data

[63] Continuation of Ser. No. 592,967, Mar. 23, 1984, abandoned.

[51] Int. Cl.[4] ..... A63B 63/08

[52] U.S. Cl. ..... 273/1.5 R; 16/52

[58] Field of Search ..... 273/1.5 R, 1.5 A; 49/383; 16/52, 59, 60; 172/264–268, 271

[56] References Cited

U.S. PATENT DOCUMENTS

| | | | |
|---|---|---|---|
| 1,731,561 | 10/1929 | Campbell et al. | 16/52 X |
| 2,735,132 | 2/1956 | Wartian | 16/52 |
| 3,143,757 | 8/1964 | Quinn | 16/52 X |
| 4,111,420 | 9/1978 | Tyner | 573/1.5 R |
| 4,353,548 | 10/1982 | Mahoney | 273/1.5 R |
| 4,438,923 | 3/1984 | Engle et al. | 273/1.5 R |
| 4,441,709 | 4/1984 | Schroeder | 273/1.5 R |
| 4,534,556 | 8/1985 | Estlund et al. | 273/1.5 R |

FOREIGN PATENT DOCUMENTS

| | | | |
|---|---|---|---|
| 569375 | 1/1924 | France | 16/52 |
| 10831 | of 1892 | United Kingdom | 49/383 |
| 1072068 | 6/1967 | United Kingdom | 16/52 |

*Primary Examiner*—Paul E. Shapiro

*Attorney, Agent, or Firm*—Kalish & Gilster

[57] ABSTRACT

A basketball goal for mounting on a backboard for providing absorption and dissipation of the energy occuring during a dunk shot or the like. The rim of the goal is pivotally mounted to the backboard and held in place by means of a spring and fluid filled hydraulic piston-cylinder mechanism which are mounted between the backboard and the rim. A downward force on the rim is opposed primarily by a vertical coil spring surrounding the cylinder. The cylinder and spring are coaxial with the axis being substantially parallel to the plane of the backboard. The downward motion of the rim opens a valve in the piston-cylinder allowing the cylinder to be moved upwardly with the downward movement of the rim with substantially no hydraulic restrictions. When the rim begins its return to normal position under spring pressure, the valve is closed. The piston has a predetermined diameter smaller than the inside diameter of the cylinder. Expansion of the compressed spring forces the piston upwardly, with the space between the piston wall and cylinder wall creating a limited flow of the fluid so as to cushion and dampen the return of the rim to its normal position.

13 Claims, 14 Drawing Figures

FIG. 1
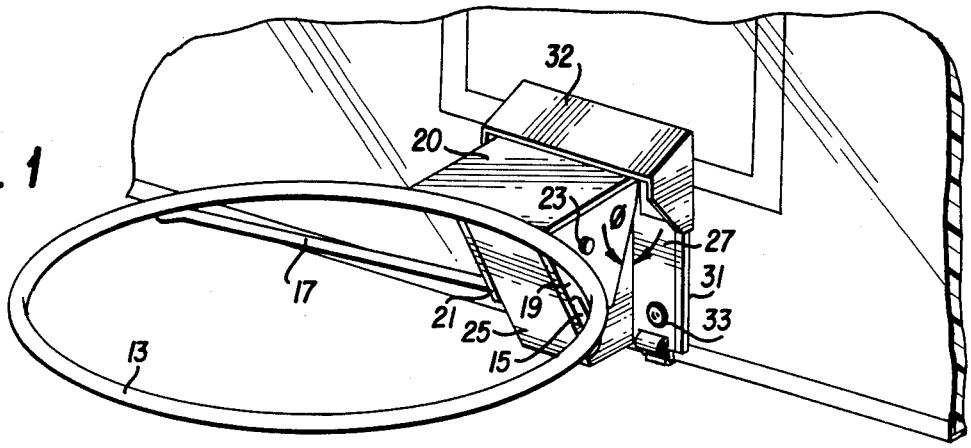
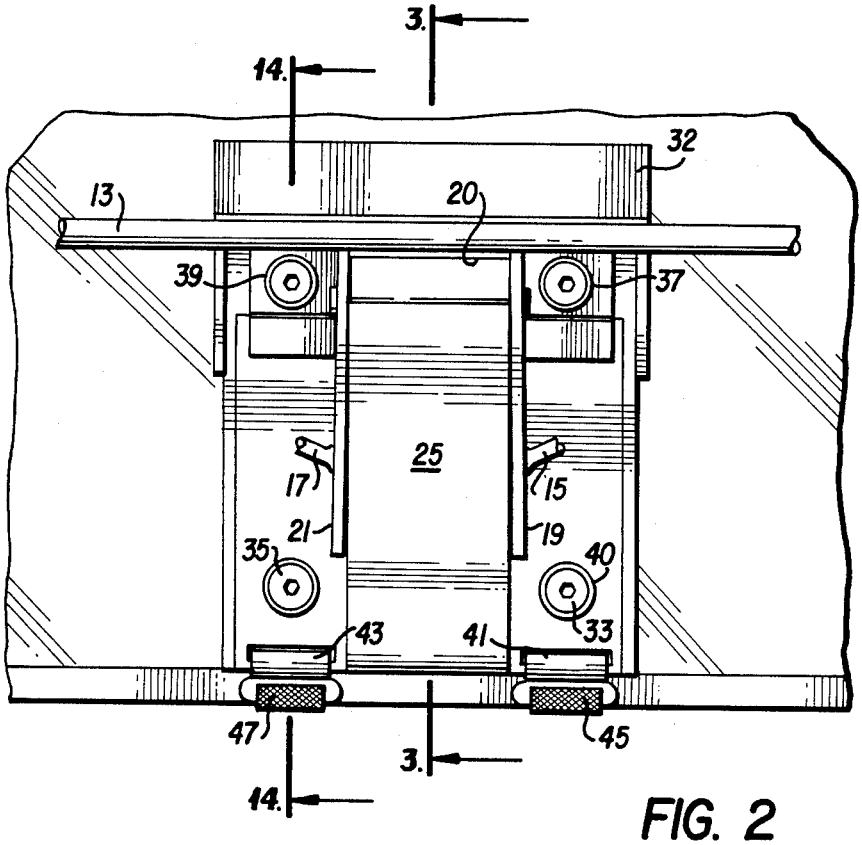
FIG. 2

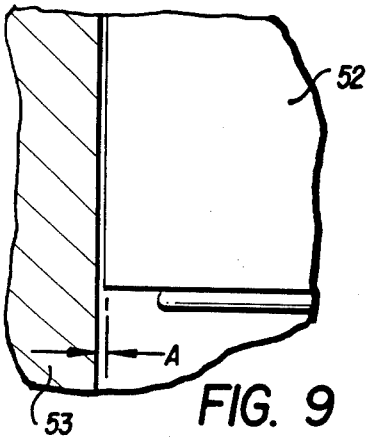
FIG. 9
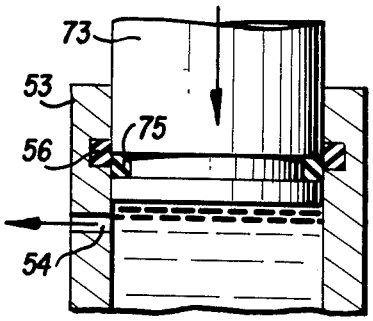
FIG. 6
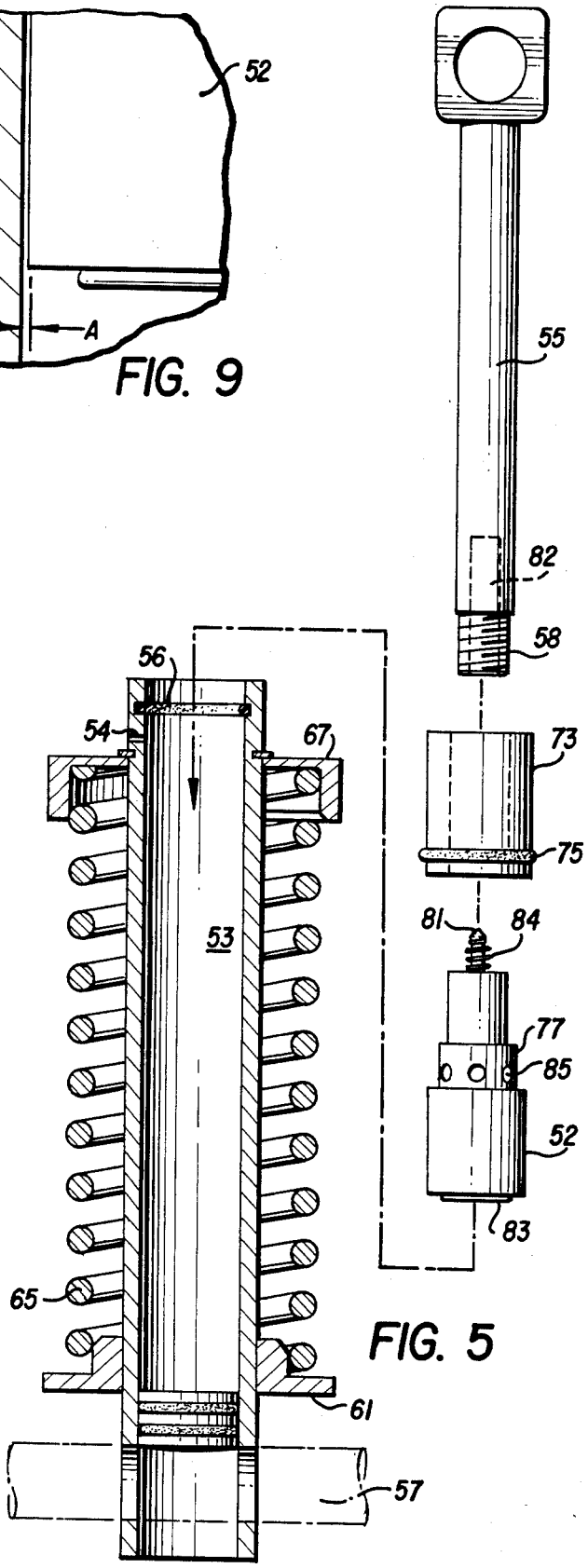
FIG. 5
FIG. 7
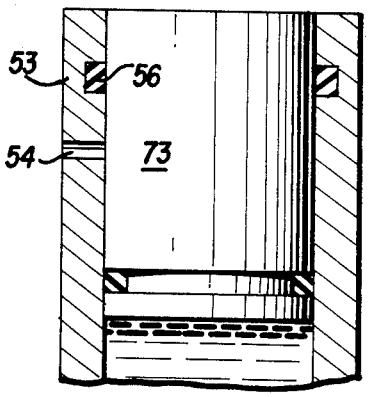
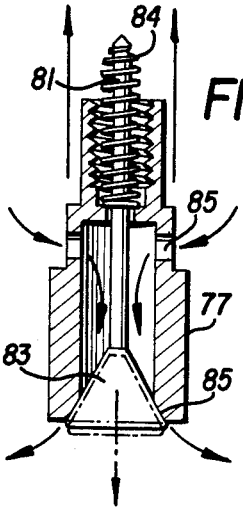
FIG. 8

BASKETBALL GOAL AND BACKBOARD UNIT

CROSS REFERENCE TO RELATED APPLICATION

This application is a continuation of application Ser. no. 06/592,967 filed Mar. 23, 1984, now abandoned.

BACKGROUND OF THE INVENTION

This invention relates generally to the combination of a basketball and backboard unit and more particularly to a basketball goal and backboard unit which provides a means for absorbing the initial shock created by contacting the goal by a player while dunking a basketball and, also, for providing for a controlled restrained return of the goal to its original operative position.

U.S. Pat. No. 4,111,420 issued Sept. 5, 1978 discloses an energy absorbing basketball/backboard unit which is hinged so as to pivot forwardly and downwardly as pressure is applied to it, as when a player dunks the basketball and also then slaps or hits or pulls the goal with his hands or arms. The goal is spring mounted from the rear of the backboard so as to resist the downward pressure and cause the goal to be returned to its original position as the spring returns to its original position. A restraining means is also mounted rearward of the backboard which comprises a shock absorber which is designed to partially reduce the impact return of the goal by acting against the return force of the springs.

While the above-identified patent does attempt to prevent the initial shock from damaging the goal and/or the backboard, it still does not totally control the return of the basket which snaps back at a fairly rapid rate even with the use of the terminal shock absorber and, thus, presents a considerable force against the backboard. Additionally, the firmness of the goal itself and the associated basketball rim is affected due to the particular structure of mounting and the use of the springs.

Further, there are no provisions for protection of the goal and/or backboard should the force be in excess of that accommodated by the springs, such as when a person hangs on the rim. Therefore, although it does provide some absorption of energy, it does not assure that the equipment cannot be destroyed.

Additionally, when the goal is depressed, there is a danger that the player may insert his hand between the goal and backboard, resulting in a serious injury upon the fast return of the goal.

Accordingly, it is an object of the present invention to provide a basketball goal wherein the force occuring during a dunk shot or the like will force the goal to rotate downwardly relative to the backboard. A spring bias is provided against which this downward force is applied. After the pressure is removed, the goal is returned to its normal position on the backboard at a relatively slow controlled rate by means of a hydraulic retention system whereby any possible damage to the goal and/or backboard is substantially eliminated. Further, the structure includes means for preventing damage due to the application of continued stress which might be placed on the basket by a person hanging therefrom. This structure includes a breakaway mechanism which allows the entire goal to break away from the backboard and hinge downwardly and be suspended therefrom so as to prevent forces sufficient to destroy the backboard and/or the goal. Additionally, a shield is provided for preventing entry of a hand or the like between the goal and the backboard.

These and other objects of this invention will be obvious from the following discussion taken together with the drawings.

FIG. 1 is a perspective view of the goal of the present invention mounted on a standard backboard;

FIG. 2 is a front view of the goal of FIG. 1;

FIG. 5 is an exploded view of the spring-hydraulic mechanism used in the goal of the present invention;

FIG. 6 is a partial sectional view of the cylinder and piston of FIG. 5 during the loading of the hydraulic fluid;

FIG. 7 is a partial sectional view of the cylinder and piston of FIG. 5 after the hydraulic fluid has been placed within the cylinder;

FIG. 8 is a sectional view of the valve structure used in FIG. 5;

FIG. 9 is an enlarged view of the relationship of the piston and inner cylinder wall of FIG. 5;

SUMMARY OF THE INVENTION

Figure 4:
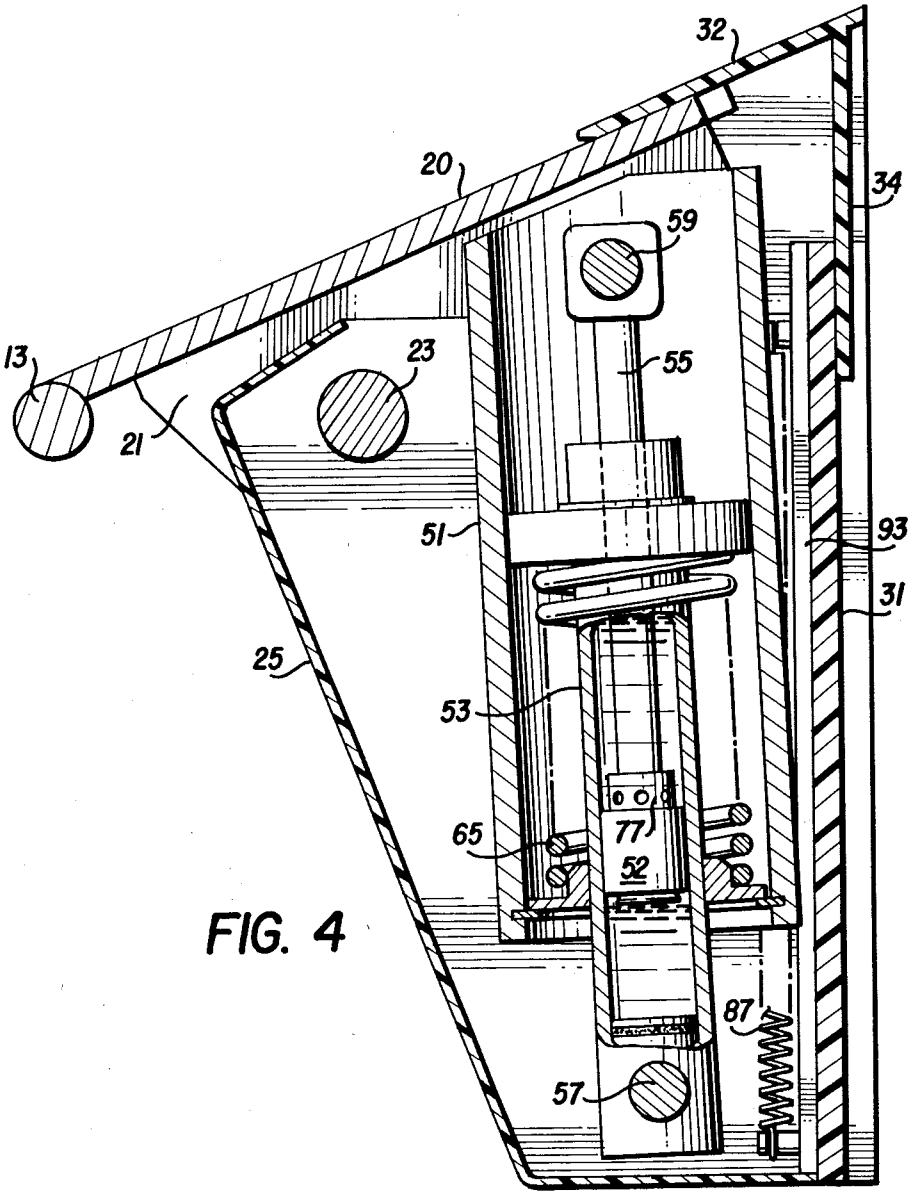
FIG. 4 is a sectional view taken along the lines 3—3 of FIG. 2 with the goal in its downwardly rotated and extended position.

The present invention provides a basketball goal for mounting on a backboard which provides absorption of the energy occuring during a dunk shot or the like. The rim is pivotally mounted to the backboard and held against the backboard in its position by means of a spring and fluid filled hydraulic cylindrical mechanism which is mounted between the backboard and the rim. A downward force of the rim is opposed primarily by a coil spring having a central axis substantially parallel to the front of the backboard and surrounding the fluid filled hydraulic piston-cylinder. The downward motion of the rim caused by the exertion of force thereon opens a valve in the piston-cylinder allowing substantially free movement of the hydraulic fluid through the valve as the piston moves upwardly with the downward movement of the rim against the force of the spring which it compresses. When the rim is released and begins to close under the expansion of the coil spring, the valve is closed and motion is retarded. This effectively retards the return motion of the rim under the pressure of the spring. The piston has a predetermined diameter smaller than the inside diameter of the cylinder and expansion of the compressed spring forces the piston downwardly, with the space between the piston wall and cylinder wall creating a limited flow of the hydraulic fluid so as to effectively cushion the return of the rim to its normal position relative to the backboard.

DETAILED DESCRIPTION OF THE INVENTION

Turning now to the drawings, FIG. 1 is a perspective view of the goal of the present invention mounted on a backboard 11. The basket rim 13 is secured to a frame including top plate 20 side plates 19 and 21 intermediate housing 25 and braces 15 and 17. The braces are welded between the rim and side plates with the rim also being secured to top plate 20 which extends between side plates 19 and 21.

rod 23 passes through side plates 19 and 21 so as to provide a pivotal point for a first frame portion comprising the side plates and top plate as will be more thoroughly described relative to the figures of the drawings subsequently discussed.

Referring to FIGS. 1 and 2, it can be seen that the intermediate backplate 27 of the housing is hinged to backplate 31 by hinges 45 and 47 with backplate 31 being secured by backboard 11, lower bolts 33 and 35. These bolts and associated hardward are constructed in such a way that they will pull through the associated boreholes in plate 27 due to the particular structure which will also be explained as the description proceeds. Upper bolts 37 and 39 are also secured through plates to the backboard.

Figure 13:
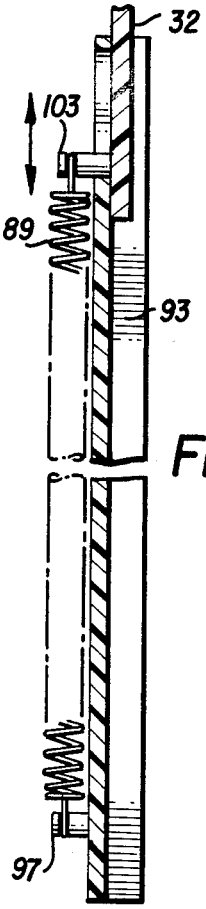
FIG. 13 is a partial sectional view taken along the lines 13—13 of FIG. 10.

When a predetermined force is exceeded, the entire rim structure, plates and housing will break away from the backboard and will be supported from the backboard by means of nylon straps 45 and 47. Details of this structure will be discussed in connection with FIGS. 13 and 14.

Figure 3:
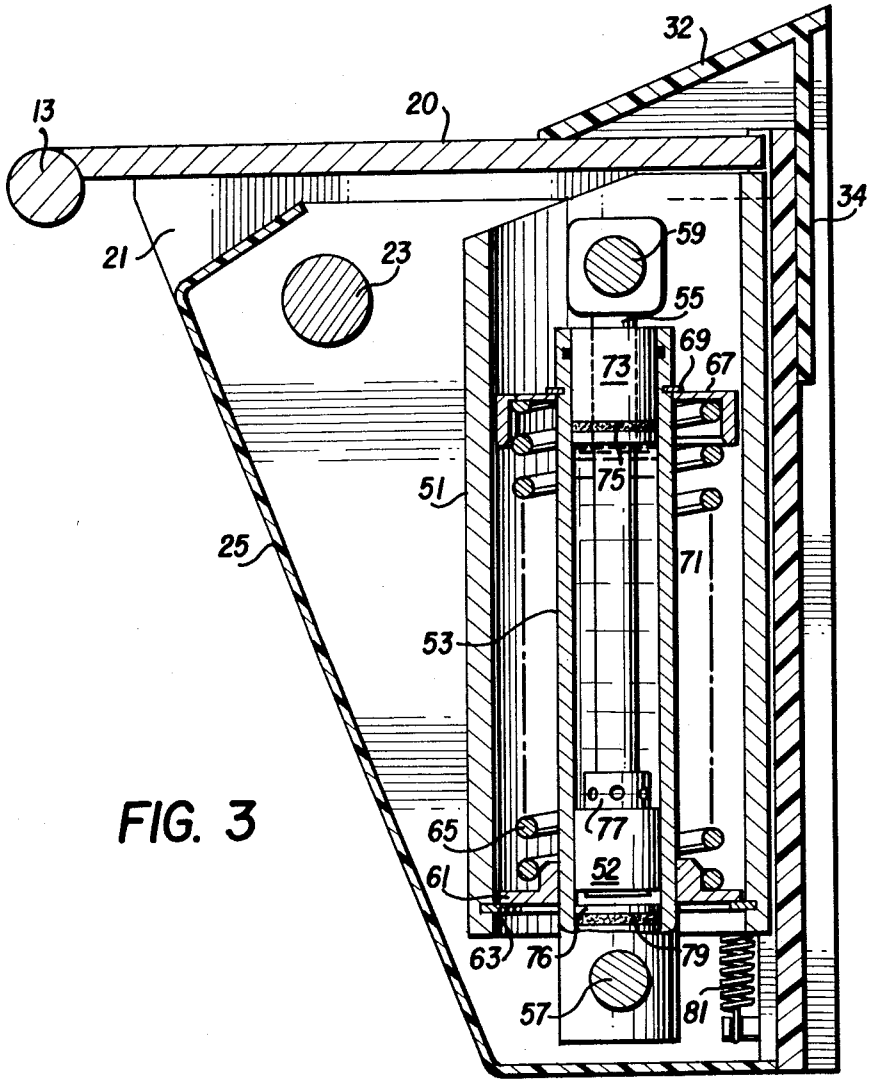
FIG. 3 is a sectional view taken along the lines 3—3 of FIG. 2 with the goal in its normal secured position.

Turning now to FIGS. 3 and 4, there is shown a cross sectional view taken along the lines 3—3 of FIG. 2, with FIG. 3 showing the rim and the associated structure in its normal position and FIG. 4 showing the rim in an extended position which has occurred as a result of a force such as a dunk shot.

A cylinder shroud 51 encloses therein cylinder 53 having associated piston 52 and rod 55. Cylinder 53 is secured to plates 19 and 21 by means of rod 57 while piston rod 55 is secured at its upper enclosure to shroud 51 by means of rod 59. Lower seat 61 rests against retaining ring 63 extending within cylinder shroud 51. The seat supports the lower end of coil spring 65 which extends upwardly and bears at its upper end against cap 67 which is, in turn, retained in position by retaining ring 69 extending from cylinder 53.

Cylinder 53 is filled with a hydraulic fluid 71 below bushing 73 which terminates and is secured within the upper end of cylinder 53 and through which piston 55 slideably passes. O-ring 75 is secured in a channel about the lower end of bushing 73.

Whereas the specific movement of piston cylinder and valve assembly 77 will be subsequently described, FIG. 4 shows the position of the basic elements when the rim has been forced downwardly. As can be seen, top plate 20 and side plates 21 and 19 rotate counterclockwise about rod 23 as rim 13 is forced downwardly. With rod 57 securing cylinder 53 against vertical movement to a second frame portion comprising intermediate housing 25, rod 59, passing through piston 55 and shroud 51 and secured to side plates 19 and 21, will move upwardly as the rim is deflected downwardly. This moves piston 55 and shroud 51 upwardly against the bias of coil spring 65 within cylinder 53. As will be subsequently explained, fluid 71 within cylinder 53 passes downwardly through valve mechanisms 77 in piston 52 into the lower part of cylinder 53. When the pressure of the rim is released, it will move upwardly but will be cushioned and damped by the reverse flow of the hydraulic fluid within cylinder 53.

Turning now to FIGS. 5 through 9, operation of the piston, cylinder and valve will be more thoroughly described. FIG. 5 is an exploded view of the piston, cylinder and valve assembly which includes cylinder 53, piston 52, valve assembly 77, bushing 73 and piston rod 55. Valve assembly 77 includes valve stem 81 and associated spring 84 terminating at the valve head 83. Valve stem 81 extends into substantially the entire length of borehole 82.

Prior to assembly of the entire structure of FIG. 5, cylinder 53 is filled with a hydraulic fluid such as oil to a point at least up to orifice 54 which passes through the wall of cylinder 53. Subsequently, bushing 73 passes downwardly beyond O-ring 56, FIG. 6, excess fluid and/or air is forced downwardly because of the seal created by O-ring 75 on bushing 73. This excess fluid passes outwardly of orifice 54 until O-ring 75 passes beyond the orifice 54. This procedure assures that no air is present in the assembled piston-cylinder system.

FIG. 8 is a sectional view of valve assembly 77. As can be seen, a plurality of orifices 85 are drilled through the assembly 77 at the upper part thereof so that the hydraulic fluid may have access to the interior of piston 52. As piston 52 moves upwardly towards the position as shown in FIG. 4, the pressure of the hydraulic fluid causes valve head 83 to move away from valve seat 85, thus creating a passage for the fluid from the upper part of cylinder 53 through the valve and into the lower part of cylinder 53 as shown in FIG. 4.

When the pressure on the rim is released, coil spring 65 commences to expand thereby moving seat 61 downwardly together with piston 55. Release of the hydraulic pressure immediately reseats valve head 83 on valve seat 85 as shown in the solid lines of FIG. 8, effectively closing off ports 85 between the upper and lower portions of cylinder 53.

FIG. 9 illustrates the particular structure that provides the cushioning effect desireable for a slow return of the rim back to its original position. As can be seen, piston 52 has an outer diameter slightly smaller than the inside diameter of cylinder 53, thus creating a circular space A between the piston and cylinder. By restricting this space A, fluid under pressure passes slowly from the lower chamber into the upper chamber of cylinder 53. Accordingly, this restrains the action of coil spring 65 so as to assure a slow, even and soft return of the rim and frame to the position shown in FIG. 3. Obviously, this avoids the deliterious effect of a sudden return under pressure of the basket to its normal position.

Basketball regulations require that the rim should not be permitted to be deflected downwardly beyond 30° from the horizontal. This is assured by means of the configuration of side plates 19 and 21 having a rear angle $\phi$, FIG. 1, relative to plate 27. Accordingly, when side plates 19 and 21 abut against plate 27, the downward motion is effectively stopped. In this particular instance, deflection is limited to 23°.

Figure 10:
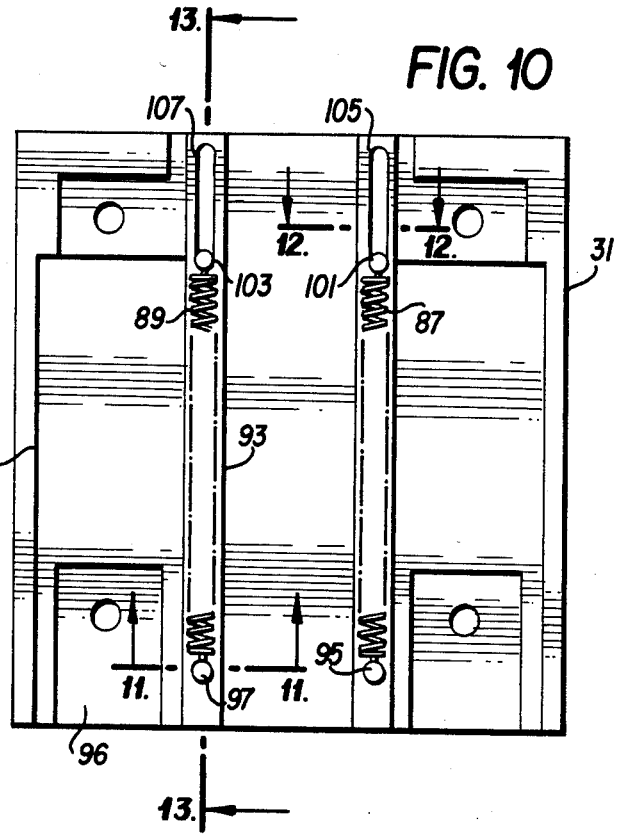
FIG. 10 is a view of the rear structure of the goal with the goal and frame removed.
Figure 11:
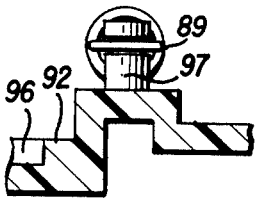
FIG. 11 is a sectional view taken along the lines 11—11 of FIG. 10.
Figure 12:
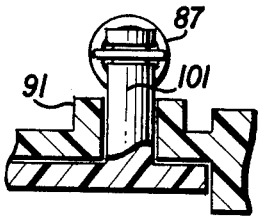
FIG. 12 is a sectional view taken along the lines 12—12 of FIG. 10.

As will be evident from FIGS. 3 and 4, shield 32 remains secured to nonmovable plate 31 by means of a backplate 34 which is integral with shield 32. This plate is secured by means such as by bolts or welding. Shield 32 is designed so as to constantly maintain contact with upper plate 20 so as to eliminate the possibility of players hands or fingers entering the area between the frame and backboard when the rim is in a deflected position. Accordingly, the shield rises together with plates 19 and 21 so as to maintain contact with plate 20 until it reaches its upper position as shown in FIG. 4. Details of this structure are shown in FIGS. 10–12. FIG. 10 is an elevational view with the goal and frame removed. In order to provide a spring means for pulling the shield downwardly when the pressure is released, springs 87 and 89 are mounted on outwardly projecting ridges 91 and 93 of plate 27 by means of pins 95 and 97 at the lower end thereof. Pins 101 and 103 are secured to the upper ends of springs 87, 89 and pass through slots 105 and 107 in plate 31 and are secured to backplate 34 of shield 32. The springs bias the hood downwardly, but are of a sufficient tension so as to allow the shield to move upwardly against such bias to the position as shown in FIG. 4. Depressions 92 and 96 are molded into plate 31 so as to accommodate the goal and frame structure.

Figure 14:
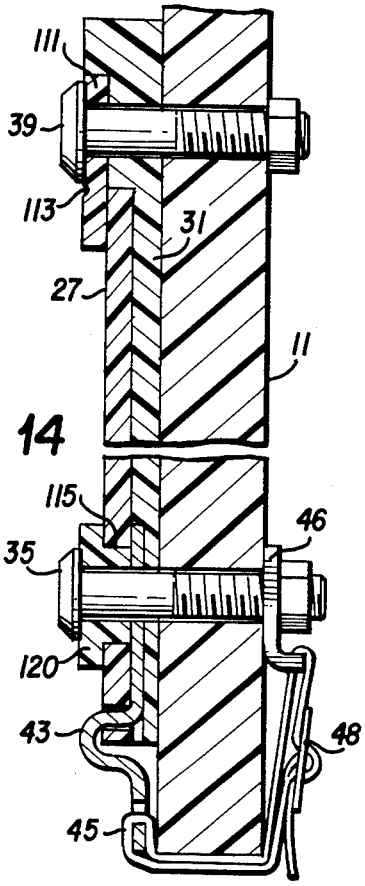
FIG. 14 is a partial sectional view showing the breakaway structure means for mounting the goal to the backboard.

As previously indicated, a mechanism has been provided to prevent damage to the rim, housing or backboard if an excessive force is exerted at a point beyond the 23° limit. Such a force may occur if a person hangs on the rim. Referring to FIG. 14, lower bolt 35 passes through an enlarged borehole 115 in plate 27 wherein the head of bolt 35 is smaller than borehole 115. A grommet 119 having a flange 120 extends into bore hole 115. The grommet is of a destructible material such as plastic or the like. The diameter of flange 120 is larger than borehole 115. The bolt extends through plate 31 and the backboard 11. Hinge 41 extends upwardly and is secured between plate 27 and plate 31.

Upper bolt 39 secures the assembly to the backboard also and includes therewith plastic insert 111 which is notched as at 113. Accordingly, when the extreme pressure as discussed above is placed on the rim, plastic insert 111 breaks away at 113 freeing the upper part of plate 27. Flange 120 on grommet 119 breaks away freeing the lower part of plate 27. Hinge 41 is secured behind plate 27 by bolt 35 and allows plate 27, including the rim and the housing to rotate about the hinge downwardly and away from backboard 11. Nylon strap 45 is secured to the lower part of hinge 41 and passes through slotted plate 46 which is also secured the backboard by the bolt and is tightened by means of strap buckle 48. This nylon strap provides a means for allowing the structure including the rim and the housing to dangle below the edge of the backboard without falling therefrom so as to prevent damage to itself or harm to any person.

As will now be evident, the present invention provides a basketball goal which absorbs pressures created by slam dunks while allowing the goal to return relatively gently against the backboard, thus substantially eliminating damage to the backboard. Additionally, the construction prevents injury to the players during movement of the goal.

The above description and drawings are illustrative only since various modifications in the structure could be made without departing from the invention, the scope of which is to be limited only by the following claims.

I claim:

1. A basketball goal for mounting on a backboard comprising a rim;

a frame having a first frame portion secured to a section of said rim and a second frame portion for being secured to a backboard;

means for pivotally mounting said first frame portion to said backboard second frame portion;

spring means mounted within said frame for biasing said frame portions to abutting position with each other;

a fluid filled cylinder provided within said frame, a piston disposed in said cylinder for relative reciprocal axial movement therein, said piston being located intermediate the ends of said cylinder when said frame portions abut each other;

means for securing said cylinder within said frame so that relative movement occurs between said piston and cylinder when said first frame portion is pivoted outwardly from said abutting position with said second frame portion against the bias of said spring, said securing means comprising a rod connected to said second frame portion and passing through the lower end portion of said cylinder for maintaining said cylinder in fixed relation to said second frame portion;

a shroud provided within said frame, said shroud surrounding said cylinder and projecting upwardly therebeyond;

a second rod, secured to said first frame portion and passing through the upper part of said shroud and the upper end portion of said piston whereby said shroud and said piston jointly move substantially upwardly relative to said cylinder when said first frame portion is pivoted away or outwardly from said second frame portion.

2. The basketball goal of claim 1 wherein said spring means comprises a seat about said cylinder secured to the lower end of said shroud;

a cap within said shroud secured to the upper end of said cylinder; and a compression spring surrounding said cylinder between said seat and said cap.

3. The basketball goal of claim 1 wherein there is provided valve means in said piston for opening when said first frame portion is pivoted away from said second frame portion and for closing when said first frame portion is returned toward said second frame portion.

4. The basketball goal of claim 3 wherein said valve means comprises a channel through said piston;

a valve seat at the lower end of said channel; and a spring loaded valve in said piston with the valve head being seated on said valve seat when said piston moves downwardly and when in a rest position, and moves away from said valve seat when said piston moves in an upwardly direction.

5. The basketball goal of claim 1 further comprising stop means for preventing said rim from being defelcted below the horizontal more than 30°.

6. The basketball goal of claim 1 wherein there is provided a one-way valve means in said piston which opens when said first frame portion is pivoted outwardly from said second frame portion against the bias of said spring means and closes as said first frame portion moves toward said abutting position under pressure from said spring means.

7. The basketball goal of claim 1 wherein said means for damping return of said first frame portion comprises a restricted passage between opposite ends of said piston for restricting the flow of the cylinder fluid so as to damp the return of said first frame portion as said spring means returns said first frame portion toward said abutting position.

8. The basketball goal of claim 1 wherein said restricted passage comprises a predetermined clearance between the outer wall of the piston and the inner wall of the cylinder.

9. A basketball goal for mounting on a backboard comprising a rim;

a frame secured to a section of said rim;

means for pivotally mounting at least a portion of said frame including said rim; for movement toward and away from the backboard;

spring means mounted within said frame for biasing said frame portion toward said backboard.

a fluid filled cylinder-piston within said frame, said piston being located intermediate the ends of said cylinder when said frame portion is positioned adjacent said backboard;

means for securing said cylinder piston within said frame so that relative movement occurs between said piston and cylinder when said frame portion is pivoted outwardly from said backboard against the bias of said spring;

and means for damping return of said portion in returning toward said backboard;

a back plate between said backboard and said frame, said frame being hinged to said back plate at the lower edge thereof;

breakaway means for securing said frame to said back plate and said backboard whereby excessive downward force on said rim ruptures said breakaway means with separation of said frame from said backboard.

10. A basketball goal as defined in claim 9 wherein strap means connect said backboard and said plate whereby upon rupture of said breakaway means said frame is suspended from said backboard by said strap means.

11. A basketball goal as defined in claim 10 wherein valve means are provided within said piston for opening when said portion is pivoted outwardly from said backboard and for closing as said portion is moved returningly toward said backboard.

12. A basketball goal for mounting on a backboard comprising a rim;

a frame secured to a section of said rim top;

means for pivotally mounting at least a portion of said frame including said rim to said backboard;

spring means mounted within said frame portion for biasing said frame toward said backboard;

a fluid cylinder-piston within said frame, said piston being located intermediate the ends of said cylinder when said frame portion is positioned adjacent said backboard;

and means for damping return of said frame portion in returning toward said backboard;

a shield extending over a portion of the top of said frame; and means for slideably mounting said shield so that it is moveable in a vertical direction as said frame portion is pivoted.

13. The basketball goal of claims 1, 9 or 12 wherein said cylinder piston and said spring are coaxial, with said axis being substantially parallel to the plane of the backboard.

* * * * *